US005586709A

United States Patent [19]

Del Fabro et al.

[11] Patent Number: 5,586,709

[45] Date of Patent: Dec. 24, 1996

[54] DEVICE TO COMPENSATE THE ELONGATION OF AT LEAST TWO WIRE RODS OR ROUND BARS, WHICH IS ASSOCIATED WITH A DRAWING ASSEMBLY

[75] Inventors: Giorgio Del Fabro, Tricesimo; Marcello Del Fabro, Udine, both of Italy

[73] Assignee: M.E.P. Macchine Elettroniche Piegatrici SpA, Reana Del Rojale, Italy

[21] Appl. No.: 503,857

[22] Filed: Jul. 18, 1995

[30] Foreign Application Priority Data

Jul. 20, 1994 [IT] Italy ..... UD94A0129

[51] Int. Cl.[6] ..... B65H 20/00; B65H 20/02

[52] U.S. Cl. ..... 226/177; 226/187

[58] Field of Search ..... 226/176, 177, 226/180, 187, 194, 21, 181

[56] References Cited

U.S. PATENT DOCUMENTS

| | | | |
|---|---|---|---|
| 2,751,069 | 6/1956 | Goodman, Jr. | 226/177 |
| 3,392,896 | 7/1968 | Ullman | 226/187 |
| 3,578,228 | 5/1971 | Steiner | 226/109 |
| 3,675,837 | 7/1972 | Gerould | 226/194 |
| 3,738,557 | 6/1973 | Week | 226/177 |
| 3,782,618 | 1/1974 | Voorhees | 226/177 |
| 4,842,180 | 6/1989 | Kato | 226/176 |

FOREIGN PATENT DOCUMENTS

| | | | |
|---|---|---|---|
| 0453943 | 10/1991 | European Pat. Off. | 226/181 |
| 494708 | 7/1992 | European Pat. Off. | B65H 51/10 |
| 0118627 | of 1901 | Germany | 226/177 |
| 1946814 | 3/1970 | Germany | B21B 31/26 |
| 3341076 | 7/1984 | Germany | B21F 23/00 |
| 1117058 | of 1956 | Metropolitan France | 226/177 |
| 0602219 | 7/1978 | Switzerland | 226/176 |

*Primary Examiner*—Daniel P. Stodola
*Assistant Examiner*—Matthew A. Kaness
*Attorney, Agent, or Firm*—Antonelli, Terry, Stout & Kraus

[57] ABSTRACT

Device to compensate the elongation of two or more wire rods or round bars on machines fed with two metallic wire rods or round bars of iron or alloys thereof of a type for building work, the machines being, for instance, bending/shaping machines, the device comprising a pair of opposed rolls (12), namely an upper roll (12*a*) and a lower roll (12*b*) respectively, the rolls (12) defining between them respective inner (17*a*) and outer (17*b*) passes (17), with which the wire rods passing through cooperate, at least one (12*a*) of those rolls (12) being able to move substantially parallel to itself on a plane containing the axes of the rolls (12), the rolls (12*a*–12*b*) having respective shafts (15*a*–15*b*) each of which is fitted to a relative support (13), namely to respective upper (13*a*) and lower (13*b*) supports, the other roll (12*b*) being able to move in a controlled rocking manner on the plane containing the axes of the rolls (12) and being adjusted by a bottom positioning screw and a return spring (22).

8 Claims, 2 Drawing Sheets

DEVICE TO COMPENSATE THE ELONGATION OF AT LEAST TWO WIRE RODS OR ROUND BARS, WHICH IS ASSOCIATED WITH A DRAWING ASSEMBLY

BACKGROUND OF THE INVENTION

This invention concerns a device to compensate the elongation of at least two wire rods or round bars, the device being associated with a drawing assembly.

The device to compensate the elongation according to the invention is applied to all machines which process at the same time at least two wire rods or round bars, the machines being, for instance, bending/shaping machines or straightening machines.

The wire rods or round bars processed with these machines are produced by hot rolling or cold rolling or by drawing and consist of so-called round bars for building work of the type employed as reinforcements for concrete.

The state of the art covers bending/shaping machines, also called stirruping machines, which are fed with round iron bars so as to produce stirrups for building work.

These machines are generally fed with round iron bars stored in the form of coiled bundles, which are uncoiled and straightened before being bent.

These coiled bundles are generally formed at the end of the hot rolling cycle.

The stirruping machines generally include at their upstream end a straightening assembly consisting of a plurality of opposed and staggered rolls, in which the wire rod or round bar is stretched so as to remove the tensions and twists therein, and also include a drawing assembly consisting of at least one pair of opposed powered rolls the axes of which lie on a plane at a right angle to the plane of feed of the wire rod or round bar to be drawn.

The feed of the wire rod is provided by the pressure exerted by the pair of drawing rolls on the wire rod, this pressure having a considerable value so as to ensure enough drawing force to prevent any possible slipping of the wire rod on the rolls.

This pressure is such as to cause plastic deformation of the wire rod or round bar to the extent of creating an elongation substantially in proportion to the pressure.

A further elongation of the wire rod is caused also by the stretching arising from the straightening action applied to the wire rod.

This overall elongation of the wire rod may even reach a value of about 3 to 6%.

Where the machine is processing only one wire rod, this elongation does not create problems inasmuch as the means which measures the length is normally placed downstream of the aforesaid straightening and drawing assemblies, so that the length measured is the real length.

So as to increase the output, these stirruping machines have for some time now been generally enabled to process at least two wire rods or round bars at the same time.

In this case the straightening and drawing assemblies normally consist of a plurality of pairs of rolls containing multiple passes, or else of multiple rolls working on the same axis.

In this case the elongation resulting from the plastic deformations caused during the straightening and drawing leads to shortcomings which have so far not been overcome.

In fact, it has been found that the elongation caused by the pressure exerted by the straightening rolls, but above all by the drawing rolls, on the wire rods differs as between the two wire rods, thus involving different measurements and leading to the formation of stirrups having different dimensions which do not comply with the pre-set design specifications.

The difference of the elongation is caused by various factors which cannot be controlled in a precise and continuous manner by the machine operator and which combine together in a manner that cannot be foreseen, and are such as the following, in particular:

- the difference of the diameters of the wire rods being processed, this difference being linked to the tolerances proper to the production process of the wire rod, causes very different elongations even though the difference between the diameters of the two wire rods being processed is much less than a millimetre;
- the difference of the tensions in the two wire rods, these tensions being removed or fixed during the straightening step, leads to different elongations;
- the different wear of the passes in the straightening rolls, but above all in the drawing rolls, causes a different deformation of the two wire rods and therefore a different elongation of the two wire rods;
- the mechanical plays both in the bearings of the rolls and in the guides for the sliding of the roll-holder slides lead to the application of different pressures on the two wire rods being processed.

To be more exact, where the rolls are fitted as cantilevers, the resilient yielding of the whole device has the effect that the drive shafts to which the rolls are fitted tend to spread apart, so that the wire rod closest to the support is squeezed to a greater extent and is therefore more elongated than the other wire rod.

All the above occurrences take place with all the pressure rolls applied, whether t hose rolls be straightening rolls or drawing rolls.

However, these deformations are greater with the drawing rolls since the pairs of drawing rolls consist of opposed rolls which are not staggered and at which the pressure exerted on the wire rods is greater and the effect is direct.

U.S. Pat. No. 3,392,896 discloses a floating ring cooperating with an inner drawing ring.

A system of resilient arms keeps the two pressure rolls pressed together.

This system is conceptually satisfactory for light pressures such as those which may be applied to coated electrical wires but is not suitable for iron bars which require, as we have said, considerable pressures for the drawing action.

DE-A-1.946.814 deals with a rolling mill stand having rolls supported as cantilevers, the stand having the purpose of processing one section at a time.

The problems of a rolling mill stand with rolls supported as cantilevers are conceptually different from those of a drawing assembly of the type of the present patent application.

SUMMARY OF THE INVENTION

The present applicants have designed, tested and embodied this invention to overcome the shortcomings of the state of the art and to achieve further advantages.

The purpose of this invention is to provide a device to compensate the elongation of at least two wire rods or round bars, the device being associated with a drawing assembly employed in machines which process simultaneously at least two wire rods or round bars consisting of steel or an alloy of iron for building work.

The compensator device according to the invention always ensures an equal elongation of the wire rods or round bars processed by these machines at the same time.

These machines may be straightening machines or bending/shaping machines such as stirruping machines, or yet other like machines in which two wire rods or round bars are processed at the same time.

The compensator device according to the invention is at the same time simple, strong and easy to adjust and can be readily applied also to existing machines with simple mechanical adaptations.

The compensator device according to the invention makes possible an overall correction of the various deformations undergone by the various wire rods or round bars at various points in the plant, namely in the straightening assembly and in the actual drawing assembly itself.

The compensator device according to the invention includes a pair of rolls fitted as cantilevers and comprising a first roll, which is fitted to a shaft able to move substantially parallel to itself on the plane that connects the axes of the two rolls, and a second roll fitted to a shaft borne by a support able to rock on that plane.

In the compensator device according to the invention the position of the shaft of the second roll in relation to the shaft of the first roll can be adjusted as desired so as to make those shafts parallel, converging or diverging according to the difference of elongation occurring in the wire rods or round bars being processed at the same time.

According to the invention adjustment means are included in cooperation with the rocking support of the shaft of the second roll and enable that shaft to be inclined as desired according to the difference of elongation of the wire rods being processed at the same time. This enables different pressures to be applied to the wire rods passing through the rolling feed passes defined in the outer surface of those rolls.

The adjustment of the value of pressure corrects the different elongations of the wire rods due to the different diameters of the wire rods being fed, to the different tensions in the wire rod is, to the mechanical installation plays associated with the installation and with the bearings and to the different wear of the rolling feed passes.

With the compensator device according to the invention it is therefore possible to ensure a uniform elongation of the wire rods being processed, irrespective of which of the above factors causes the differences in the values of the deformation of the two wire rods.

According to a first embodiment of the invention the compensator device acts also as a drawing assembly, with at least one of the two rolls being of necessity powered.

According to a second embodiment of the invention the compensator device is associated with an independent drawing assembly and can be fitted equally well upstream or downstream of that assembly. In this case the rolls of the compensator device can be idler rolls or powered rolls.

BRIEF DESCRIPTION OF THE DRAWING

The attached figures are given as a non-restrictive example and show a preferred embodiment of the invention as follows.

DETAILED DESCRIPTION OF THE PREFERRED EMBODIMENTS

Figure 1:
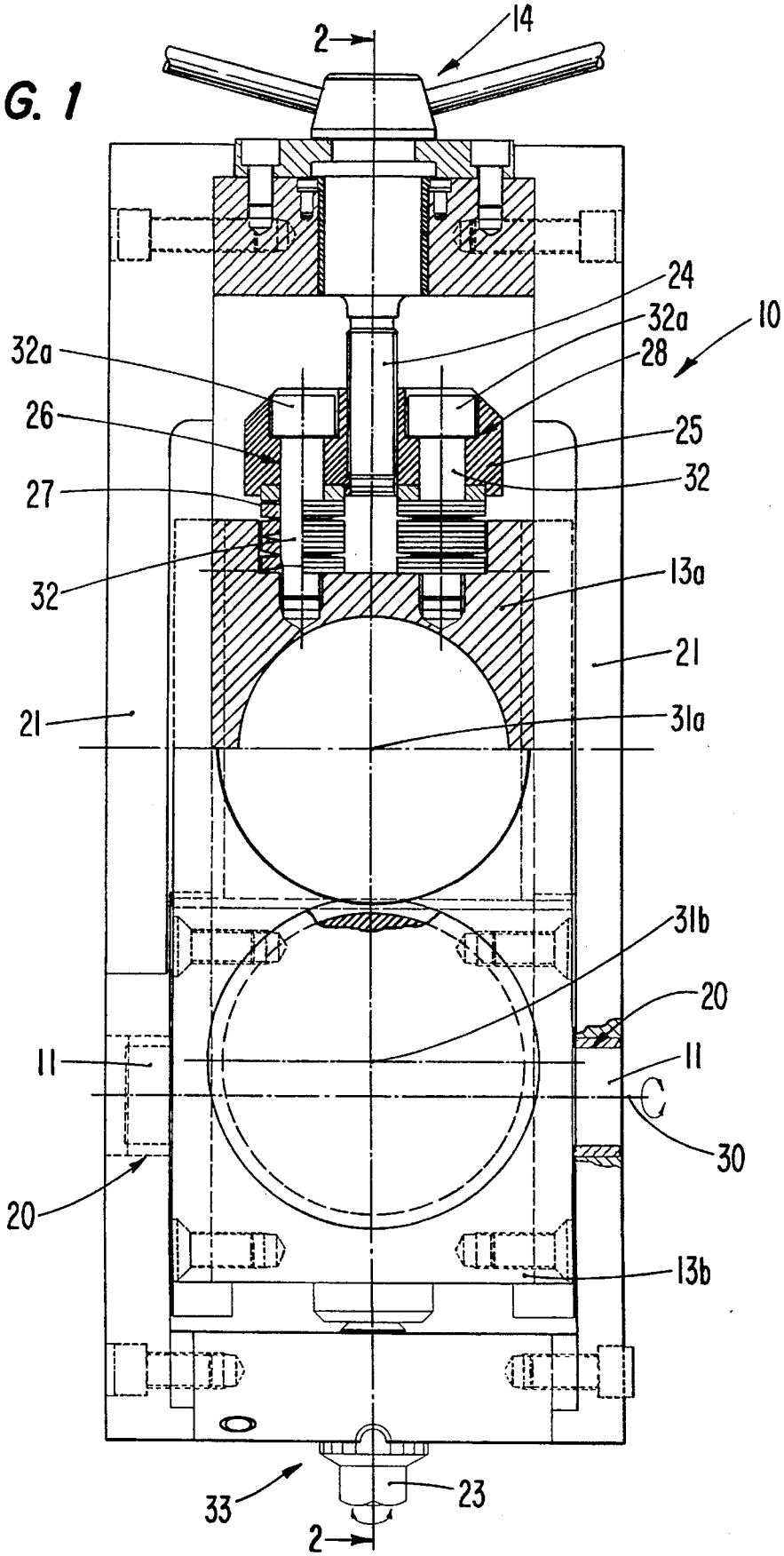
FIG. 1 shows a lengthwise section of a compensator device according to the invention, which acts also as a drawing assembly.
Figure 2:
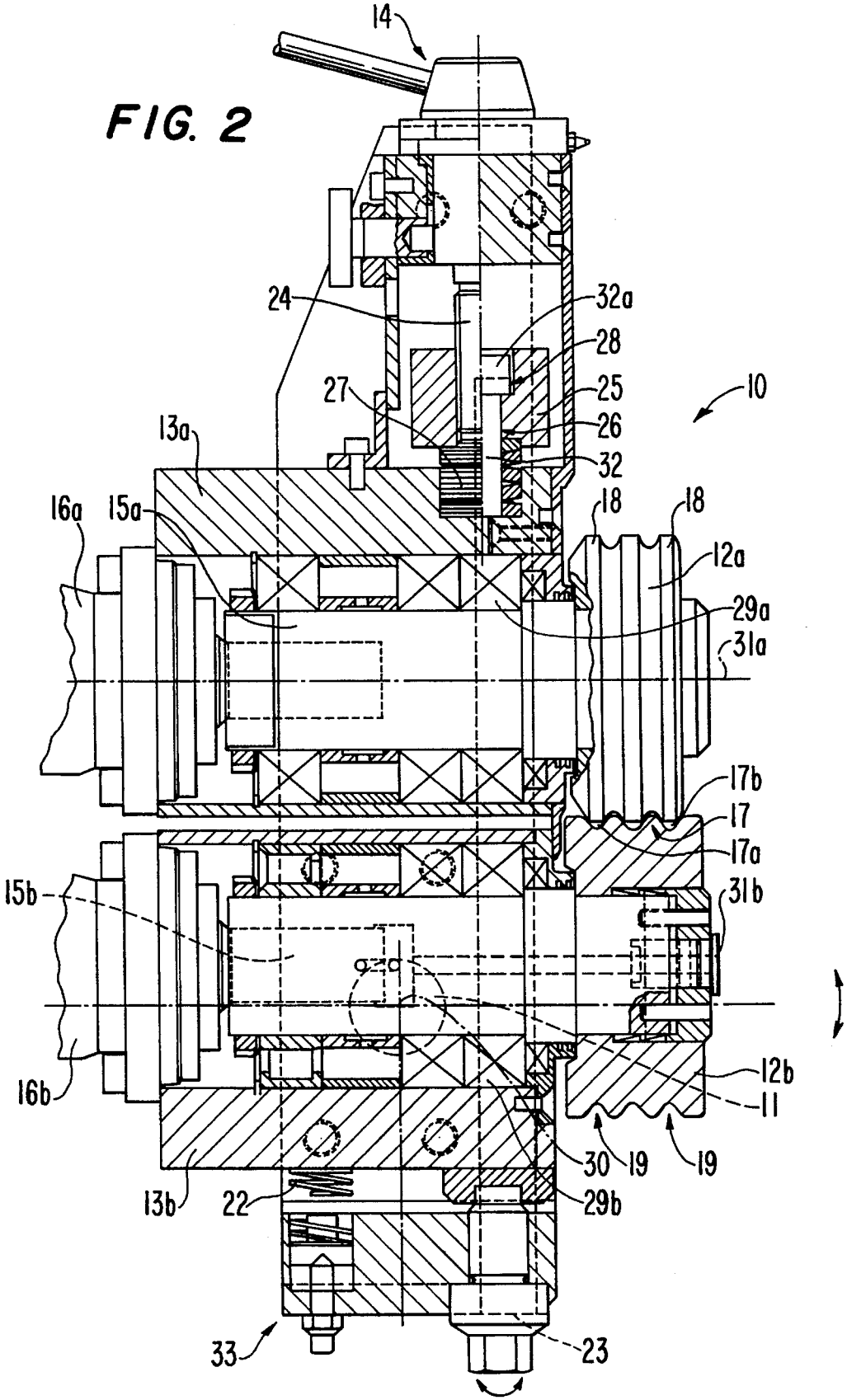
FIG. 2 shows a lengthwise section of the compensator device along the line A—A of FIG. 1.

The reference number 10 in the attached figures denotes generally a device to compensate the elongation of at least two wire rods or round bars according to the invention.

The device 10 to compensate the elongation according to the invention is applied advantageously, but not only, to a bending/shaping machine such as a stirruping machine, which is fed at the same time with at least two metallic wire rods or round bars.

The compensator device 10 according to the invention comprises a pair of rolls, namely an upper roll 12*a* and lower roll 12*b* respectively, having their axes parallel and superimposed on each other but suitably distanced apart so as to define a rolling pass with which the wire rods or round bars to be drawn cooperate.

This compensator device 10 in this case has the upper roll 12*a* fitted to an upper support 13*a*, which can be adjusted vertically in the plane passing through the axis of the rolls 12*a*, 12*b* and can thus be moved substantially parallel to itself, whereas the lower roll 12*b* is fitted to a lower support 13*b*, which can rock on that plane.

In this case the height of the upper support 13*a* can be adjusted, according to the nominal diameter of the wire rods or round bars passing through, by acting on an adjustment handwheel 14 positioned above. The handwheel 14 acts on an upper screw 24 that actuates an element 25 cooperating at its lower end with the upper support 13*a*.

To be more exact, in this case the element 25 contains through holes 26 acting as sliding guides for lower screws 32 that are anchored to the upper support 13*a*. These through holes 26 have at their upper end abutments 28, which cooperate with the heads 32*a* of the lower screws 32 and limit the travel of the same 32.

In this case thrust springs 27 are placed between the lower face of the element 25 and the upper face of the upper support 13*a* and make possible the absorbing and compensation of any small variations in the size of the wire rods or round bars caused, for instance, by the inclusion of outer ribs on ribbed bars intended for building work.

According to a variant characterised by a greater rigidity of the compensator device 10 according to the invention, the upper screw 24 is anchored directly to the upper support 13*a*, and in this way the element 25, the lower screws 32 and the thrust springs 27 are eliminated.

By acting clockwise or anticlockwise on the handwheel 14, the upper support 13*a* is moved lengthwise along lateral guides 21, and the height of rolling feed passes 17 defined between the rolls 12*a*–12*b* is therefore altered.

In the case shown as a mere example the upper roll 12*a* includes three circumferential ridges 18 positioned so as to coincide with three circumferential grooves 19 in mating positions in the lower roll 12*b*. The assembly of each circumferential ridge 18 with each circumferential groove 19 forms a rolling pass 17 for one wire rod or round bar.

The rolling passes 17, which are two or three in number, can be embodied also with different forms on the rolls 12, but this situation is unimportant for the purposes of the invention.

In this case the rolling passes 17 are three in number, of which the two lateral passes, an inner pass 17*a* and outer pass 17*b* respectively, have a smaller diameter than the central pass, which is employed to process one single wire rod of a bigger diameter, whereas the two lateral passes 17*a* and 17*b* are employed to process two wire rods at the same time.

Each roll 12 is associated with a shaft, 15*a* and 15*b* respectively, which is fitted to respective main bearings 29*a* and 29*b*.

In this case the compensator device 10 according to the invention acts also as a drawing assembly and each shaft 15*a*–15*b* is associated with a respective mating hydraulic motor 16*a*–16*b*, which is only shown partly here.

According to a variant the compensator device 10 according to the invention is fitted upstream or downstream of an independent drawing assembly, the rolls 12*a* and 12*b* of which may be idler rolls or powered rolls.

In the description that follows, by inner pass 17*a* shall be meant the pass nearest to the motors 16, whereas by outer pass 17*b* shall be meant the pass farthest from the motors 16.

In the compensator device 10 according to the invention the lower support 13*b* is fitted so as to be able to rock on the plane which contains the axes of the two shafts 15 *a*, 15*b* so that it can thus compensate the difference of elongation which the two wire rods being processed tend to have; this difference of elongation is due to the different pressure exerted by the drawing rolls and to other factors relating to the dimension of the wire rods themselves and to variables which cannot be controlled in a continuous and precise manner by the machine operator, such as, for instance, the mechanical plays in the guides and bearings, and still other factors.

In the compensator device 10 according to the invention the respective rolls 12*a* and 12*b* are installed as cantilevers on their relative shafts 15*a*–15*b*, and the pressure exerted by those rolls 12*a*, 12*b* on the wire rods or round bars being fed tends to deform resiliently those shafts 15*a*, 15*b* which bend and spread apart outwards.

In the compensator device 10 according to the invention, the different pressure exerted by the rolls 12*a*, 12*b* on the wire rod running through the inner pass 17*a*, and therefore also the resulting different deformation and different elongation of the wire rod as compared to the deformation and elongation of the wire rod running through the outer pass 17*b*, are compensated by the rocking of the lower support 13*b*.

In this case, the lower support 13*b* includes on its outer sidewalls two coaxial rocking pivots 11, which are substantially perpendicular to the plane containing the axes of the two shafts 15*a*, 15*b* and define a rocking axis 30.

As regards the type of rocking which it is desired to achieve, the rocking axis 30 connecting the two rocking pivots 11 can pass in the vicinity of the axis 31*b* of the lower drive shaft 15*b* or above or below the same.

With regard again to the type of rocking which it is desired to achieve, the rocking axis 30 along the lower drive shaft 15*b* can be located in a more or less advanced position or in a more or less retracted position.

The rocking pivots 11 are lodged in containing and rotation seats 20 included in coordinated positions in lateral containing guide s 21 of the compensator device 10.

The rocking travel of the lower support 13*b* is adjusted by adjustment means 33 consisting in this case of a bottom adjustment contrast screw 23 positioned towards the front side of the device and defining the end of maximum rocking travel.

The bottom adjustment contrast screw 23 is actuated so as to adjust the pressure of the rolls 12 on the two wire rods or round bars cooperating respectively with the inner pass 17*a* and the outer pass 17*b* so as to achieve a uniform elongation of those two wire rods.

The bottom adjustment contrast screw 23 includes advantageously on its circumference reference notches which cooperate with a graduated scale to define exactly the angular position of the axis 31*b* of the lower roll 12*b* in relation to the axis 31a of the upper roll 12*a*.

According to a variant the bottom adjustment contrast screw 23 is associated with a motor governed by reading and monitoring means which read and monitor the different elongation of the wire rods passing through.

In this case the adjustment means 33 comprise also a return spring 22 positioned on the opposite side to the bottom adjustment contrast screw 23 in relation to the rocking pivots 11.

This return spring 22 is optional and has the task of clamping resiliently the lower support 13*b* in contact with the bottom adjustment contrast screw 23, thus preventing possible damage and noise arising from the free rocking of the lower support 13*b* when there is no wire rod within the rolling passes 17.

The rocking axis 30 in relation to the adjustment means 33 is positioned in this case at the centre line between the return spring 22 and thee bottom adjustment contrast screw 23.

According to a variant the rocking axis 30 can be located in any desired intermediate position between the return spring 22 and the bottom adjustment contrast screw 23, this position being determined in relation to the effect which it is desired to obtain on the rolls 12.

We claim:

1. Device to compensate the elongation of two or more wire rods or round bars on machines fed with two metallic wire rods or round bars of iron or alloys thereof of a type for building work, the device comprising a pair of opposed rolls comprising an upper roll and a lower roll, the pair of opposed rolls defining between them respective inner and outer passes, with which the wire rods passing through cooperate, at least one roll of the pair of opposed rolls being able to move substantially parallel to itself on a plane containing the axes of the pair of opposed rolls, the pair of opposed rolls having respective shafts fitted to respective upper and lower supports, wherein the lower roll is able to move in a controlled rocking manner on the plane containing the axes of the pair of opposed rolls, the rocking being controlled by a bottom positioning screw and a return spring.

2. Compensator device as in claim 1, in which movement of the upper roll on the plane containing the axes of the pair of opposed rolls is controlled by a handwheel which actuates an upper screw for moving an intermediate element in a vertical direction, the intermediate element being operably connected to the upper support, whereby vertical movement of the intermediate element moves the upper roll substantially parallel to itself on the plane containing the axes of the pair of opposed rolls, and wherein a thrust spring is interposed between the intermediate element and the upper support for absorbing small variations in size of the wire rods or round bars.

3. Compensator device as in claim 1, in which the lower support of the shaft of the lower roll includes rocking pivots lying on a single axis and being opposite to each other, the single axis being substantially perpendicular to the plane containing the axes of the pair of opposed rolls and being positioned below the axis of the lower roll.

4. Compensator device as in claim 1, in which at least one roll of the pair of opposed rolls is an idler roll.

5. Compensator device as in claim 1, in which at least one roll of the pair of opposed rolls is powered.

6. Device to compensate the elongation of two or more wire rods or round bars on machines fed with two metallic wire rods or round bars of iron or alloys thereof of a type for building work, the device comprising a pair of opposed rolls,comprising an upper roll and a lower roll, the pair of opposed rolls defining between them respective inner and outer passes, with which the wire rods passing through cooperate, at least one roll of the pair of opposed rolls being able to move substantially parallel to itself on a plane containing the axes of the pair of opposed rolls, the pair of opposed rolls having respective shafts fitted to respective upper and lower supports, and at least one rocking pivot operably connected to the lower support and having a rocking axis perpendicular to the plane containing the axes of the pair of opposed rolls, whereby the lower roll is able to move in a controlled rocking manner about the rocking axis on the plane containing the axes of the pair of opposed rolls, and adjustment means for adjusting a maximum value of the rocking of the lower roll about the at least one pivot.

7. Compensator device as in claim 6, in which the adjustment means comprises an adjustment screw in operable contact with the lower support for adjusting the maximum value of rocking of the lower roll about the at least one pivot.

8. Compensator device as in claim 7, in which the adjustment means further comprises a return spring, the return spring being in operable contact with the lower support at a position on an opposite side of the rocking axis passing through the at least one pivot as the adjustment screw, whereby the return spring resiliently presses the lower support into contact with the adjustment screw.

* * * * *